US005927556A

United States Patent [19]

Mooney et al.

[11] Patent Number: 5,927,556

[45] Date of Patent: Jul. 27, 1999

[54] SAFETY DISPENSING CAP

[76] Inventors: Michael M. Mooney; Donna L. Mooney, both of 612 S. Elmwood Ave., Glenolden, Pa. 19036

[21] Appl. No.: 08/861,893

[22] Filed: May 22, 1997

[51] Int. Cl.[6] ..... B67D 5/32

[52] U.S. Cl. ..... 222/153.14; 215/206; 222/511; 222/525; 222/545

[58] Field of Search ..... 222/153.14, 511, 222/559, 522–525, 521, 520, 545; 215/206, 315, 388; 220/714, 715

[56] References Cited

U.S. PATENT DOCUMENTS 3,311,247 3/1967 Rigor ..... 215/206
3,757,981 9/1973 Harris, Sr. et al. ..... 222/545 X
3,797,704 3/1974 Dykes ..... 215/206 X
5,547,111 8/1996 Geiger et al. ..... 222/522 X
5,622,284 4/1997 Sawicki ..... 222/153.14
5,680,969 10/1997 Gross ..... 222/525 X

*Primary Examiner*—Kevin P. Shaver

[57] ABSTRACT

A new safety dispensing cap for deterring children from gaining access to harmful liquids. The inventive device includes an inner cap adapted to be attached to a container, a delivery nozzle extending upward from the inner cap, an outer cap disposed around the inner cap for rotational and axial movement relative thereto, a first valve for controlling flow through the nozzle, and a second valve for controlling flow through the nozzle. The outer cap must be moved both axially and circumferentially on the inner cap to open the first and second valves.

20 Claims, 3 Drawing Sheets

SAFETY DISPENSING CAP

BACKGROUND OF THE INVENTION

1. Field of the Invention

The present invention relates to child proof safety caps and more particularly pertains to a new safety dispensing cap for deterring children from gaining access to harmful liquids.

2. Description of the Prior Art

The use of child proof safety caps is known in the prior art. More specifically, child proof safety caps heretofore devised and utilized are known to consist basically of familiar, expected and obvious structural configurations, notwithstanding the myriad of designs encompassed by the crowded prior art which have been developed for the fulfillment of countless objectives and requirements.

Known prior art child proof safety caps include U.S. Pat. No. 5,271,524; U.S. Pat. No. 4,020,981; U.S. Pat. No. 4,729,487; U.S. Pat. No. 4,285,437; U.S. Pat. No. 4,223,794 and U.S. Pat. No. Des. 270,521.

While these devices fulfill their respective, particular objectives and requirements, the aforementioned patents do not disclose a new safety dispensing cap. The inventive device includes an inner cap adapted to be attached to a container, a delivery nozzle extending upward from the inner cap, an outer cap disposed around the inner cap for rotational and axial movement relative thereto, a first valve for controlling flow through the nozzle, and a second valve for controlling flow through the nozzle. The outer cap must be moved both axially and circumferentially on the inner cap to open the first and second valves.

In these respects, the safety dispensing cap according to the present invention substantially departs from the conventional concepts and designs of the prior art, and in so doing provides an apparatus primarily developed for the purpose of deterring children from gaining access to harmful liquids.

SUMMARY OF THE INVENTION

In view of the foregoing disadvantages inherent in the known types of child proof safety caps now present in the prior art, the present invention provides a new safety dispensing cap construction wherein the same can be utilized for deterring children from gaining access to harmful liquids.

The general purpose of the present invention, which will be described subsequently in greater detail, is to provide a new safety dispensing cap apparatus and method which has many of the advantages of the child proof safety caps mentioned heretofore and many novel features that result in a new safety dispensing cap which is not anticipated, rendered obvious, suggested, or even implied by any of the prior art child proof safety caps, either alone or in any combination thereof.

To attain this, the present invention generally comprises an inner cap adapted to be attached to a container, a delivery nozzle extending upward from the inner cap, an outer cap disposed around the inner cap for rotational and axial movement relative thereto, a first valve for controlling flow through the nozzle, and a second valve for controlling flow through the nozzle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new safety dispensing cap apparatus which has many of the advantages of the child proof safety caps mentioned heretofore and many novel features that result in a new safety dispensing cap which is not anticipated, rendered obvious, suggested, or even implied by any of the prior art child proof safety caps, either alone or in any combination thereof.

It is another object of the present invention to provide a new safety dispensing cap which may be easily and efficiently manufactured and marketed.

It is a further object of the present invention to provide a new safety dispensing cap which is of a durable and reliable construction.

An even further object of the present invention is to provide a new safety dispensing cap which is susceptible of a low cost of manufacture with regard to both materials and labor, and which accordingly is then susceptible of low prices of sale to the consuming public, thereby making such safety dispensing cap economically available to the buying public.

Still yet another object of the present invention is to provide a new safety dispensing cap which provides in the apparatuses and methods of the prior art some of the advantages thereof, while simultaneously overcoming some of the disadvantages normally associated therewith.

Still another object of the present invention is to provide a new safety dispensing cap for deterring children from gaining access to harmful liquids.

Yet another object of the present invention is to provide a new safety dispensing cap which includes an inner cap adapted to be attached to a container, a delivery nozzle extending upward from the inner cap, an outer cap disposed around the inner cap for rotational and axial movement relative thereto, a first valve for controlling flow through the nozzle, and a second valve for controlling flow through the nozzle.

Still yet another object of the present invention is to provide a new safety dispensing cap that is easy for an adult to use, but which is difficult for a child to use.

Even still another object of the present invention is to provide a new safety dispensing cap that is difficult to remove from a container unless a proper procedure for removal is followed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
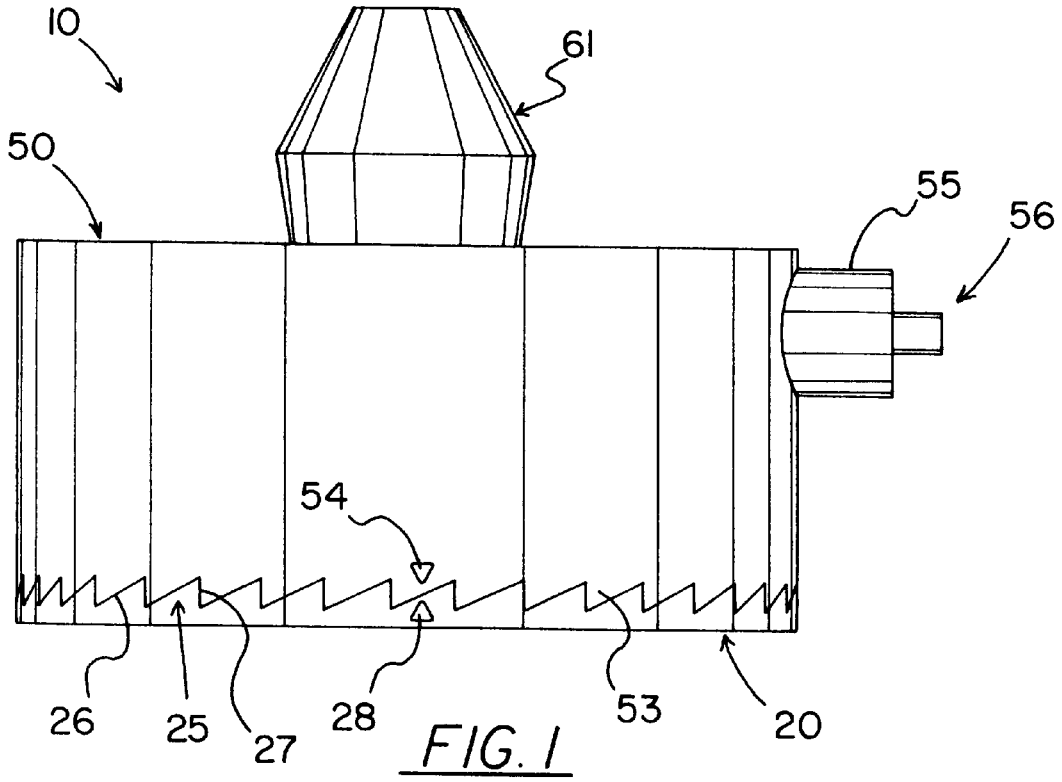
FIG. 1 is a side view of a new safety dispensing cap according to the present invention, in an assembled state.
Figure 2:
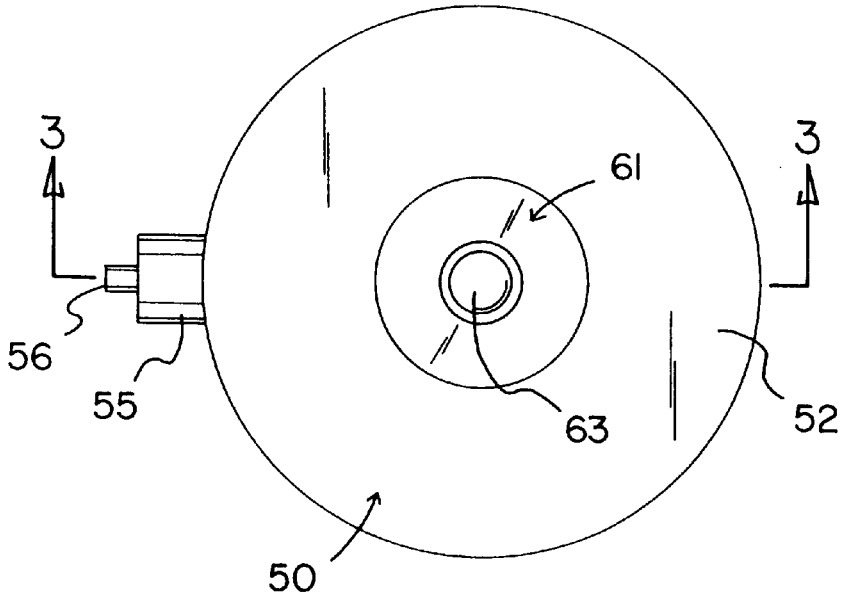
FIG. 2 is a top view thereof.

With reference now to the drawings, and in particular to FIGS. 1 through 5 thereof, a new safety dispensing cap embodying the principles and concepts of the present invention and generally designated by the reference numeral 10 will be described.

More specifically, it will be noted that the safety dispensing cap 10 comprises an inner cap 20 attached to the top of a container 15 which holds a flowable material, and an outer cap 50 disposed over the inner cap 20.

As best illustrated in FIGS. 1 through 5, it can be shown that the inner cap 20 has a top wall 21 and a cylindrical skirt 22 extending downward from the top wall. The skirt 22 includes threads 23 on an inside surface thereof for attaching the inner cap to matching threads on the container 15. The skirt 22 also includes a flange 24 at the bottom end of the skirt which extends radially outward from the skirt. Circumferentially spaced teeth 25 project from an upper surface of the flange, for a purpose which will become later apparent. The teeth 25 are defined by a sloped surface 26 and a straight surface 27, similar to conventional clutch teeth. An indicating mark 28, such as an arrow, is formed on the outer edge of the flange 24.

Figure 3:
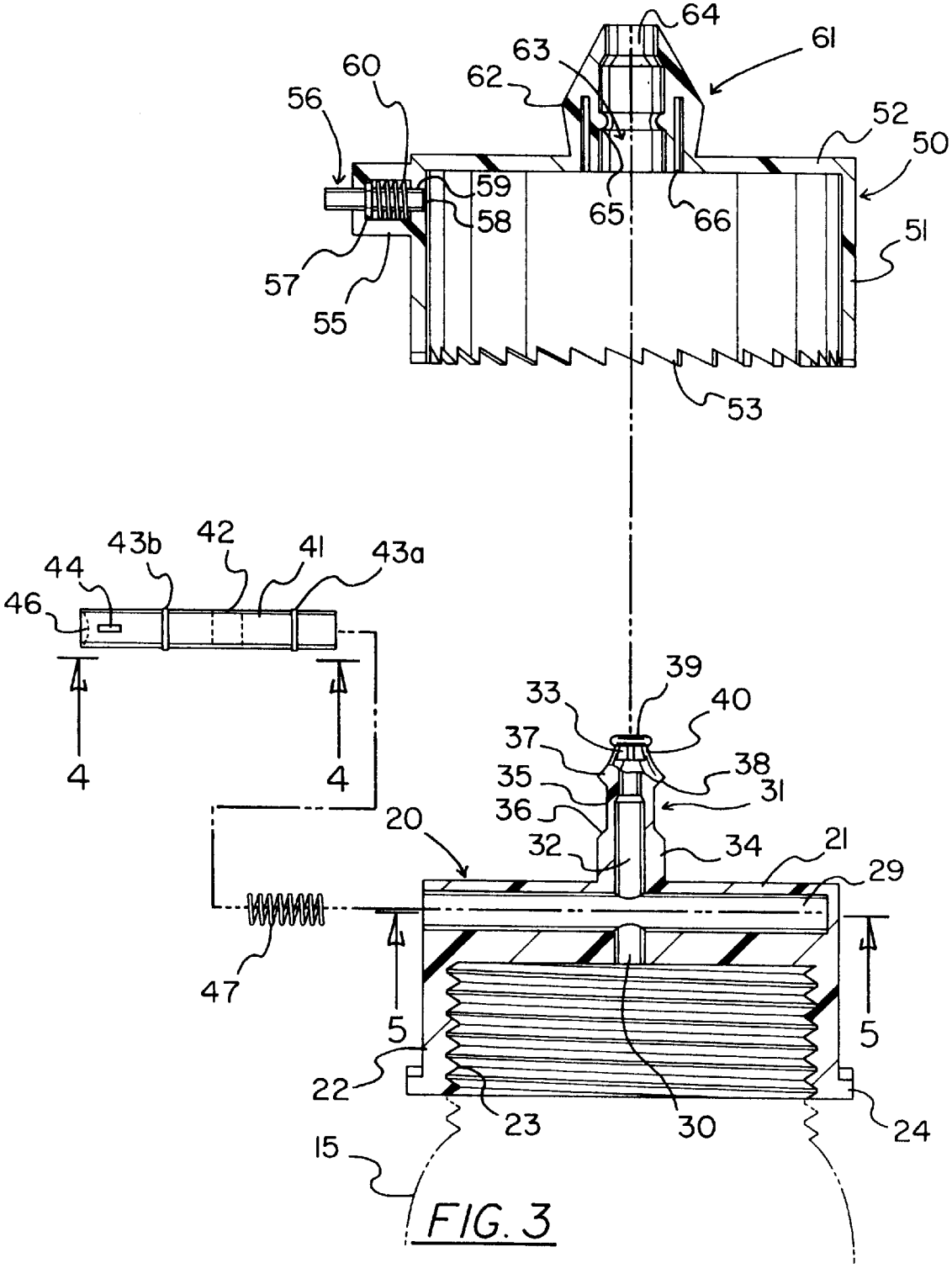
FIG. 3 is an exploded isometric illustration of the elements of the present invention taken along line 3—3 of FIG. 2.
Figure 4:
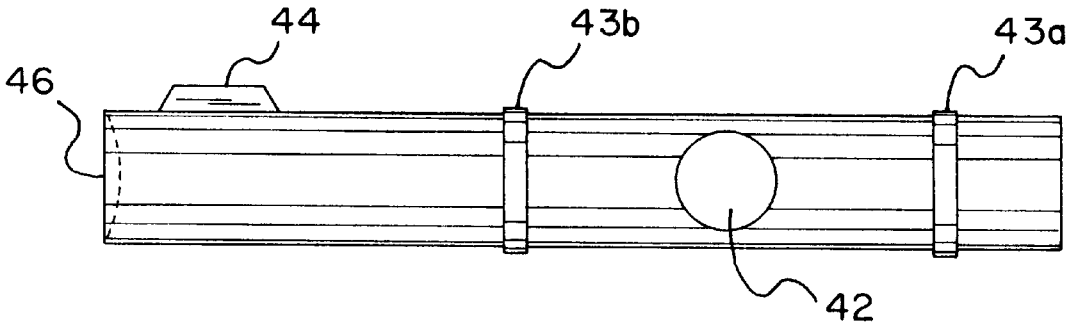
FIG. 4 is a view taken along line 4—4 of FIG. 3.
Figure 5:
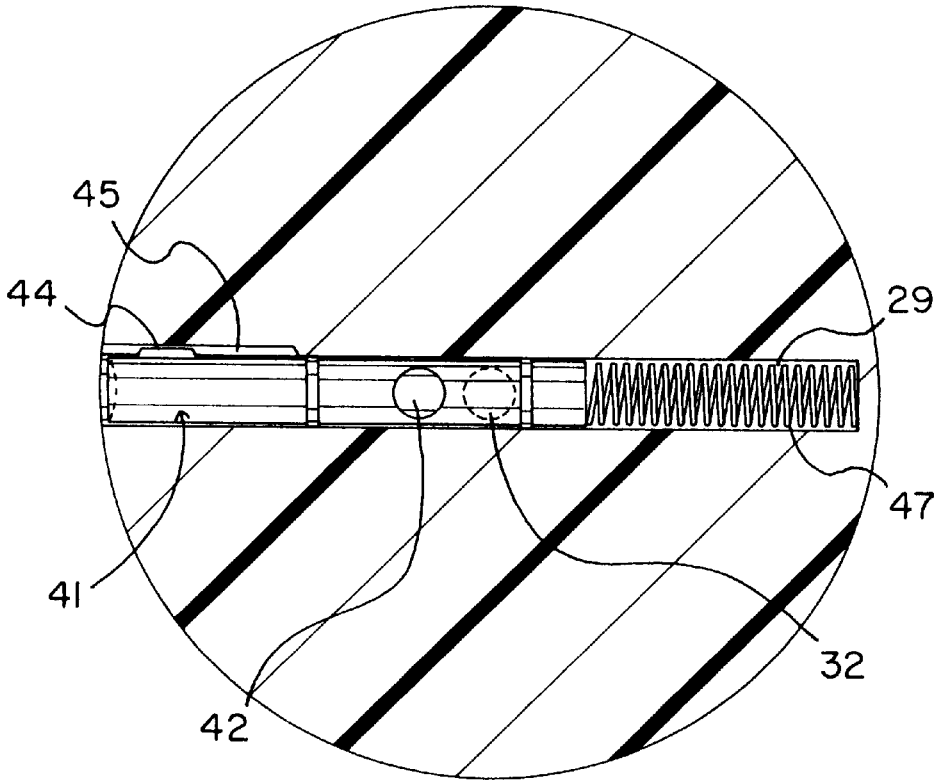
FIG. 5 is a cross sectional view taken along line 5—5 of FIG. 3.

Valve chamber 29 is formed in the top wall 21 of the inner cap. The chamber 29 is closed at one end and extends through the side of the top wall at the other end, as best seen in FIG. 3. A passage 30 provides communication between the interior area of the skirt 22 and the chamber 29 to allow material to flow to the chamber.

A delivery nozzle 31 is connected to, and extends upward from, the top of the wall 21. The nozzle 31 includes an interior passage 32 extending from the top of the chamber 29 to discharge openings 33 at the distal end of the nozzle. The nozzle 31 has an enlarged bottom portion 34, a neck region 35 separated from the portion 34 by a tapered shoulder 36, and an enlarged top portion 37 having a tapered shoulder 38. Above enlarged portion 37 is a plug 39 which is connected to the portion 37 by three circumferentially spaced struts 40 which define three discharge openings 33 therebetween. Thus liquid is able to flow from the container through the passage 30, through the chamber 29, through the passage 32, and out of the openings 33.

Slidably disposed within the chamber 29 is a valve rod 41 for controlling the flow of liquid into the nozzle 31. The rod 41 has a hole 42 therethrough for selectively communicating the passages 30,32. The rod 41 includes O-ring seals 43*a*, 43*b* which sealingly contact the chamber wall for preventing flow of liquid out of the chamber 29. A spline 44 extends from the rod and fits within a groove 45 in the wall of the chamber for preventing rotation of the rod within the chamber. One end of the rod is made slightly concave 46 for engagement with an actuator to be later described. Coil spring 47 is disposed within the chamber 29 between the closed end of the chamber and the rod end, to bias the rod to the left (as viewed in FIGS. 3 and 5) and to a position such that the passage 42 is not aligned with the passages 30,32. This misalignment prevents liquid flow into the nozzle.

The outer cap 50 fits over the inner cap 20 and is able to move axially relative thereto, and also rotated relative thereto. The cap 50 includes a cylindrical skirt 51 extending downward from a top wall 52. The bottom end of the skirt 51 includes circumferentially spaced teeth 53 which can be selectively engaged with the teeth 25 on the inner cap by pushing the outer cap axially downward. By engaging the teeth 25,53, the outer and inner caps are locked together such that the caps rotate together when the outer cap is rotated. However, when the teeth are disengaged by axially raising the outer cap, the outer cap can be rotated while the inner cap remains stationary. Indicating mark 54 is disposed on the skirt 51 at a predetermined circumferential location.

Actuator housing 55 is formed on an upper portion of the skirt 51 for housing an actuating button 56 for actuating the valve rod 41. The button 56 has a flange 57 inside of the housing 55 and a rounded actuating end 58 able to extend through a hole 59 in the skirt 51. Coil spring 60 is disposed within the housing 55 between the flange 57 and the skirt 51 for biasing the button 56 radially outward. By properly aligning the hole 59 and the open end of the valve chamber 29, the valve rod 41 is able to be moved against the bias of the spring 47 by pushing the button 56, which causes the actuating end 58 to contact the concave rod end 46, moving the valve rod 41 to the position where the passages 30,42,32 are all aligned, permitting liquid flow into the nozzle 31. The concavity of the end 46 and the rounded end 58 ensure better contact between the actuator and the rod 41.

Integrally attached to, and extending from, the top wall 52 is a valve nozzle 61. The outer surface of the nozzle 61 includes a generally central ridge 62 to facilitate an upward pulling motion on the nozzle 61 and cap 50. The nozzle 61 includes a central passage 63 extending completely therethrough, into which fits the delivery nozzle 31. The passage 63 defines a narrow upper region 64 which sealingly receives the plug 39 to prevent flow from the openings 33. The wall defining the passage 63 includes a rounded shoulder 65 extending into the passage. When the nozzle 31 is inserted into the passage 63, the rounded shoulder 65 slides between the enlarged portions 34,37 along the neck region 35. The enlarged portions 34,37 thus define the range of axial movement of the outer cap 50 and nozzle 61. The nozzle 61 includes a circumferential gap 66 behind the shoulder 65 to permit flexing of the shoulder 65 and the nozzle wall, thus enabling the shoulder 65 to fit over the enlarged portions 34,37.

The nozzle 61 and cap 50 are therefore axially movable between a closed, no-flow position, where the plug 39 is received with the narrow region 64 of the passage and the shoulder 65 will be disposed over the enlarged portion 34, and an open, flow position, where the shoulder 65 is at the top of the neck region 35 adjacent the shoulder 38. It should be noted that in the closed position of the nozzle 61, the teeth 25,53 are engaged, and the hole 59 is located axially below the open end of the chamber 29 preventing actuation of the rod 41. Thus the nozzle 61 and the valve rod 41 are both closed to prevent flow in the closed position of the cap.

In order to dispense fluid from the container 15, the outer cap 50 must be lifted axially until the teeth disengage, which removes the plug 39 from the narrow region 64, then the outer cap must be rotated until the indicating marks 28,54 are vertically aligned. Alignment of the marks indicates that the hole 59 is aligned with the open end of chamber 29, permitting the button 56 to be pressed so as to move the valve rod 41 to the open position, thus permitting fluid flow from the cap 10. Thus fluid can only be dispensed by a three step process of axially lifting the outer cap, circumferentially rotating the outer cap, and pushing the actuating button. Such a three step process makes it difficult for a child to use. Note that cap 10 can be removed from the container when the button is actuating the rod, by rotating the outer cap in the opposite direction from the attachment direction, since the actuating button locks the inner and outer caps together. Additionally, it should be noted that the sloped tooth surfaces 26 prevent removal of the cap 10 when the teeth are engaged due to opposite rotation of the outer cap, since the sloped surfaces 26 will slide over each other in this rotation direction.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An apparatus for dispensing flowable material from a container, comprising:

an inner cap means having attachment means adapted to attach the inner cap means to the container;

a nozzle means extending from said inner cap means;

an outer cap means disposed over the inner cap means;

a first valve means for selectively controlling the flow of material through the nozzle means; and a second valve means for selectively controlling the flow of material through the nozzle means;

wherein the outer cap means and the inner cap means include interengaging means which are selectively engaged and disengaged, such that when engaged said inner cap means rotates with said outer cap means to attach the inner cap means to the container, and when disengaged the outer cap means rotates relative to the inner cap means.

2. The dispensing apparatus of claim 1, wherein the interengaging means comprise teeth on both the outer cap means and the inner cap means.

3. An apparatus for dispensing flowable material from a container, comprising:

an inner cap means having attachment means adapted to attach the inner cap means to the container;

a nozzle means extending from said inner cap means;

an outer cap means disposed over the inner cap means;

a first valve means for selectively controlling the flow of material through the nozzle means; and a second valve means for selectively controlling the flow of material through the nozzle means;

wherein the first valve means comprises a valve member disposed on the inner cap means, and further comprising an actuating means for actuating the valve member, said actuating means being disposed on the outer cap means;

wherein the valve member comprises a rod disposed in a chamber in the inner cap means and mounted for reciprocating movement within the chamber, a biasing means disposed in the chamber for biasing the rod in a direction such that it prevents flow through the nozzle means, and said actuating means pushes said rod with a force sufficient to overcome the biasing force of the biasing means to move the rod to a position permitting flow through the nozzle means.

4. The dispensing apparatus of claim 3, further including means for preventing rotation of the rod within the chamber.

5. The dispensing apparatus of claim 3, wherein the outer cap means is rotationally supported upon the inner cap means, said actuating means being able to actuate the valve member only when said outer cap means is rotated to a predetermined circumferential location relative to the inner cap means.

6. The dispensing apparatus of claim 3, wherein the second valve means comprises a valve nozzle extending from the outer cap means and disposed over the nozzle means.

7. The dispensing apparatus of claim 6, wherein the outer cap means is supported on said inner cap means such that the outer cap means can move axially relative to the inner cap means, said valve nozzle controlling the flow through the nozzle means upon axial movement of the outer cap means.

8. The dispensing apparatus of claim 3, wherein the outer cap means and the inner cap means include interengaging means which are selectively engaged and disengaged, such that when engaged said inner cap means rotates with said outer cap means to attach the inner cap means to the container, and when disengaged the outer cap means rotates relative to the inner cap means.

9. The dispensing apparatus of claim 8, wherein the interengaging means comprise teeth on both the outer cap means and the inner cap means.

10. A dispensing cap comprising:

an inner cap having a first cylindrical skirt with attachment means disposed thereon, the first skirt sized to allow the attachment means to engage with a container to attach the inner cap thereto;

a delivery nozzle extending upward from the inner cap, the delivery nozzle including an apertured discharge end;

an outer cap disposed over the inner cap and having a second cylindrical skirt disposed around the first cylindrical skirt, said outer cap being supported for axial and rotational movement relative to the inner cap;

said first cylindrical skirt and said second cylindrical skirt including projecting means which are engaged upon axial movement of the outer cap in one axial direction such that the inner cap rotates with the outer cap during rotation of the outer cap in one rotational direction;

a first valve member on the inner cap for selectively controlling flow into the delivery nozzle;

an actuator for actuating the first valve member, the actuator being disposed on said second cylindrical skirt and able to actuate the first valve member only when the outer cap is rotated to a predetermined circumferential location relative to the inner cap;

a second valve member extending upward from the outer cap and disposed around the delivery nozzle for selectively controlling flow out of the discharge end; and said second valve member being opened to permit flow from the discharge end only upon axial movement of the outer cap member in a direction opposite the one axial direction, and said first valve member being opened to permit flow into the delivery nozzle only after said second valve member is opened and the outer cap is rotated to the predetermined circumferential location.

11. The dispensing cap of claim 10, wherein the valve member comprises a rod disposed in a chamber in the inner cap and mounted for reciprocating movement within the chamber, a biasing means disposed in the chamber for biasing the rod in a direction such that it prevents flow into the delivery nozzle, and said actuator pushes said rod with a force sufficient to overcome the biasing force of the biasing means to move the rod to a position permitting flow into the delivery nozzle.

12. The dispensing cap of claim 11, further including means for preventing rotation of the rod within the chamber.

13. The dispensing cap of claim 12, wherein the rotation preventing means comprises a spline on the rod disposed within a groove in a wall of the chamber.

14. The dispensing cap of claim 11, wherein the biasing means biases the valve rod to a flow preventing position when the outer cap is rotated from said predetermined circumferential location.

15. The dispensing cap of claim 10, wherein the projecting means comprise teeth attached to the bottom of the first cylindrical skirt and teeth attached to the bottom of the second cylindrical skirt.

16. An apparatus for dispensing flowable material from a container, comprising:

an inner cap means having attachment means adapted to attach the inner cap means to the container;

a nozzle means extending from said inner cap means;

an outer cap means disposed over the inner cap means;

a first valve means for selectively controlling the flow of material through the nozzle means; and a second valve means for selectively controlling the flow of material through the nozzle means;

wherein the first valve means comprises a valve member disposed on the inner cap means, and further comprising an actuating means for actuating the valve member, said actuating means being disposed on the outer cap means;

wherein the outer cap means is rotationally supported upon the inner cap means, said actuating means being able to actuate the valve member only when said outer cap means is rotated to a predetermined circumferential location relative to the inner cap means.

17. The dispensing apparatus of claim 16, wherein the second valve means comprises a valve nozzle extending from the outer cap means and disposed over the nozzle means.

18. The dispensing apparatus of claim 17, wherein the outer cap means is supported on said inner cap means such that the outer cap means can move axially relative to the inner cap means, said valve nozzle controlling the flow through the nozzle means upon axial movement of the outer cap means.

19. The dispensing apparatus of claim 16, wherein the outer cap means and the inner cap means include interengaging means which are selectively engaged and disengaged, such that when engaged said inner cap means rotates with said outer cap means to attach the inner cap means to the container, and when disengaged the outer cap means rotates relative to the inner cap means.

20. The dispensing apparatus of claim 19, wherein the interengaging means comprise teeth on both the outer cap means and the inner cap means.

* * * * *